US008306253B2

(12) United States Patent
Devlas et al.

(10) Patent No.: US 8,306,253 B2
(45) Date of Patent: Nov. 6, 2012

(54) MODULAR INPUT/OUTPUT HEADSET AND METHOD OF USE

(75) Inventors: Paul Devlas, San Rafael, CA (US); Adithya M. R. Padala, Sausalito, CA (US); Joe Tate, Sausalito, CA (US)

(73) Assignee: UME Voice, Inc., Novato, CA (US)

( * ) Notice: Subject to any disclaimer, the term of this patent is extended or adjusted under 35 U.S.C. 154(b) by 341 days.

(21) Appl. No.: 12/608,789

(22) Filed: Oct. 29, 2009

(65) Prior Publication Data

US 2010/0111349 A1 May 6, 2010

Related U.S. Application Data

(60) Provisional application No. 61/110,441, filed on Oct. 31, 2008.

(51) Int. Cl.
*H04R 25/00* (2006.01)

(52) U.S. Cl. ..... 381/370; 381/374; 381/377

(58) Field of Classification Search ..... 381/109, 381/370, 374, 384
See application file for complete search history.

(56) References Cited

U.S. PATENT DOCUMENTS

2002/0186858 A1 12/2002 Masuda et al.
2008/0165986 A1* 7/2008 Daniels et al. ..... 381/109

FOREIGN PATENT DOCUMENTS

KR 200220309 4/2001
KR 10-2001-0053019 * 8/2001
KR 20020061776 7/2002
KR 20020066165 8/2002

OTHER PUBLICATIONS

International Search Report from International Patent Application No. PCT/US2009/062759, dated Jun. 11, 2010.

* cited by examiner

*Primary Examiner* — Davetta W Goins
*Assistant Examiner* — Amir Etesam
(74) *Attorney, Agent, or Firm* — LeClairRyan, a Professional Corporation

(57) ABSTRACT

A modular headset and method of use comprises a headset band having a first end and a second end. The headset includes a first node coupled to the first end of the headset band in which the first node has a plurality of first jacks. Each first jack selectively receives a first plug of a peripheral device. The headset includes a second node coupled to the second end of the headset band. The second node has a plurality of second jacks. Each second jack selectively receives a second plug of the peripheral device. The headset includes circuitry coupled to the jacks at the first and second nodes, wherein signals from a peripheral device are received or transmitted to any of the first jacks in the first node and signals from the external electronic device are received or transmitted to any of the second jacks in the second node.

18 Claims, 5 Drawing Sheets

MODULAR INPUT/OUTPUT HEADSET AND METHOD OF USE

RELATED APPLICATIONS

The present application claims the benefit of priority based on U.S. Provisional Patent Application Ser. No. 61/110,441, filed on Oct. 31, 2008, in the name of inventors Paul Devlas, Adithya M. R. Padala, and Joe Tate, entitled "Modular Input/Output Headset", all commonly owned herewith.

TECHNICAL FIELD

The present disclosure relates generally to a modular input/output headset.

BACKGROUND

The use of portable media and mobile phones at home, at work or on the go is extremely popular these days. Many peripheral devices like headphones and hands free microphones are being increasingly used to allow people to enjoy of their music, videos and conversations. With mobile phones now able to play media as well as media players being able to handle phone calls, existing peripheral devices are limited because they are designed for one particular type of use. For example, hand-free microphones allow people to safely drive their vehicles while having a conversation on their mobile phone. However, these microphones do not provide the same experience when listening to a song on the phone.

What is needed is a modular headset which is capable of interchangeably connecting with several different types of peripheral devices based on the user's need.

OVERVIEW

A portable headset having one or more input jacks configured to receive one or more peripheral devices, whereby the headset is configured to allow the peripheral devices to be interchangeably connected to the headset. The circuitry and design of the jacks preferably allow any standard type of peripheral device such as speakers, microphones, A/V inputs as well as any type of appropriate electronic device to operate with the headset.

In an aspect, a modular headset comprises a headset band having a first end and a second end. The headset includes a first node coupled to the first end of the headset band in which the first node has a plurality of first jacks. Each first jack selectively receives a first plug of a peripheral device. The headset includes a second node coupled to the second end of the headset band. The second node has a plurality of second jacks. Each second jack selectively receives a second plug of the peripheral device. The headset includes circuitry coupled to the jacks at the first and second nodes, wherein signals from a peripheral device are received or transmitted to any of the first jacks in the first node and signals from the external electronic device are received or transmitted to any of the second jacks in the second node.

In an aspect, a modular headset comprises a curved headset band having a first end and a second end in which the headset is adapted to fit around a person's head. A first node is coupled to the first end of the headset band and has a first jack and a second jack. The first jack is adapted to receive a selectively removable plug of an electronic device and the second jack is adapted to receive a plug of selectively removable first speaker. A second node is coupled to the second end of the headset band and has a third jack adapted to receive a plug of a selectively removable second speaker. Circuitry coupled to the first, second, and third jacks allows signals to pass therebetween, wherein signals to and from the electronic device pass through the first jack and signals from the electronic device to be audibly output by passing through the second and third jacks to the first and second output speakers.

In an aspect, a modular headset comprises a headset band having a first end and a second end, in which the headset is adapted to fit around a person's head. A plurality of jacks are coupled to the headset band, whereby each jack is configured to interchangeably connect with a plurality of peripheral devices. Circuitry is coupled to the plurality of jacks, in which the circuitry is configured to allow signals from a first peripheral device connected to a first jack to be communicated to any other jack in the plurality.

In an aspect, a method comprises selecting a curved headset band having a first end and a second end and adapted to fit around a person's head. The method comprises selecting a first node coupled to the first end of the headset band, the first node having a first jack and a second jack, wherein the first jack is adapted to receive a selectively removable microphone and the second jack configured to receive a selectively removable first output speaker. The method comprises selecting a second node coupled to the second end of the headset band, in which the second node has a third jack that is adapted to removably connect the headset to an electronic device and a fourth jack to receive a removable second output speaker. The method including configuring circuitry in electrical communication with the first, second, third and fourth jacks, wherein output signals from the electronic device to the headset travel via the third jack to the second jack and the fourth jacks to be output via the first and second output speakers, and input signals from the microphone travel via the first jack to the second jack and to the electronic device.

In an aspect, a method of operating a modular headset comprises selecting a curved headset band having a first end and a second end, the headset adapted to fit around a person's head, in which the headset band includes a first node coupled to the first end and having a plurality of first jacks. The headset band includes a second node coupled to the second end and having a plurality of second jacks, the headset including circuitry coupled to the jacks at the first and second nodes. The method comprises inserting a plug of a wire connected to an external electronic device into the first jack and inserting a plug of a speaker into the second jack, wherein signals from the external electronic device pass through the wire, the jack and the circuitry to be output to the speaker. The plug of the wire is removable from the first jack and operates when inserted into the second jack and wherein the plug of the speaker is removable from the second jack and operates when inserted into the first jack.

In an aspect, a modular headset comprises a headset band having a first end and a second end, in which the headset is adapted to fit around a person's head. A first node is removably coupled to the first end of the headset band, wherein the first node has a plurality of first jacks, each first jack adapted to selectively receive a first plug of an input or output peripheral device. A second node is removably coupled to the second end of the headset band, wherein the second node has a plurality of second jacks, each second jack adapted to selectively receive a second plug of an input or output peripheral device. The headset includes circuitry coupled to the jacks at the first and second nodes, wherein signals from a peripheral device are capable of being received or transmitted to any of the first jacks in the first node, wherein the signals from the external electronic device are capable of being received or transmitted to any of the second jacks in the second node.

In one or more of the above aspects, one or more of the plurality of first jacks further comprises a first input/output jack, wherein the first input/output jack is configured to transmit signals to and from the peripheral device connected thereto. In one or more of the above aspects, the peripheral device is the external electronic device, wherein signals to and from the peripheral device pass through the first input/output jack. In one or more of the above aspects, the peripheral device is an integrated microphone and speaker device, wherein signals to and from the integrated microphone and speaker pass through the first input/output jack. In one or more of the above aspects, the peripheral device is an electronic device comprising a mobile phone and/or media player. In one or more of the above aspects, one or more of the plurality of second jacks further comprises a second input/output jack, wherein the second input/output jack is configured to transmit signals to and from a peripheral device connected thereto.

In one or more of the above aspects, one of the plurality of first jacks further comprises a first input jack configured to removably receive a plug of a microphone, wherein an input signal from the microphone is transmittable via the circuitry to the external electronic device through the first input/output jack. In one or more of the above aspects, one of the plurality of first jacks further comprises a first output jack configured to removably receive a plug of a first speaker, wherein an input signal from the external electronic device is transmittable via the circuitry to the first speaker through the first output jack. In one or more of the above aspects, one of the plurality of second jacks further comprises a second output jack configured to removably receive a plug of a first speaker, wherein the input signal from the external electronic device is transmittable via the circuitry to the second speaker through the second output jack, wherein the first and second speakers are headphone speakers adapted to be in contact with the person's ears. In one or more of the above aspects, the first and second speakers are standalone speakers adapted to output sound in a free-space. In one or more of the above aspects, the first node and/or second node is removable from the headset band.

In one or more of the above aspects, a fourth jack connected to the circuitry and configured to selectively receive or transmit signals via the circuitry, the fourth jack configured to receive a plug of a microphone, wherein signals from the microphone pass through the fourth jack to the electronic device via the first jack. In one or more of the above aspects, the plug of the external electronic device is removable from the first jack and insertable into the second jack. In one or more of the above aspects, the plug of the first output speaker is removable from the second jack and insertable into the first jack. In one or more of the above aspects, the first and second speakers are headphone speakers adapted to be in contact with the person's ears. In one or more of the above aspects, the first and second speakers are standalone speakers adapted to output sound in a free-space.

BRIEF DESCRIPTION OF THE DRAWINGS

The accompanying drawings, which are incorporated into and constitute a part of this specification, illustrate one or more examples of embodiments and, together with the description of example embodiments, serve to explain the principles and implementations of the embodiments.

In the drawings.

DESCRIPTION OF EXAMPLE EMBODIMENTS

Example embodiments are described herein in the context of a modular headset. Those of ordinary skill in the art will realize that the following description is illustrative only and is not intended to be in any way limiting. Other embodiments will readily suggest themselves to such skilled persons having the benefit of this disclosure. Reference will now be made in detail to implementations of the example embodiments as illustrated in the accompanying drawings. The same reference indicators will be used throughout the drawings and the following description to refer to the same or like items.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

In accordance with this disclosure, the components, process steps, and/or data structures described herein may be implemented using various types of operating systems, computing platforms, computer programs, and/or general purpose machines. In addition, those of ordinary skill in the art will recognize that devices of a less general purpose nature, such as hardwired devices, field programmable gate arrays (FPGAs), application specific integrated circuits (ASICs), or the like, may also be used without departing from the scope and spirit of the inventive concepts disclosed herein. It is understood that the phrase "an embodiment" encompasses more than one embodiment and is thus not limited to only one embodiment.

In general to what is described herein is a portable headset having one or more input jacks configured to receive one or more peripheral devices, whereby the headset is configured to allow the peripheral devices to be interchangeably connected to the headset. The circuitry and design of the jacks preferably allow any standard type of peripheral device such as speakers, microphones, A/V inputs as well as any type of appropriate electronic device to operate with the headset.

Figure 1:
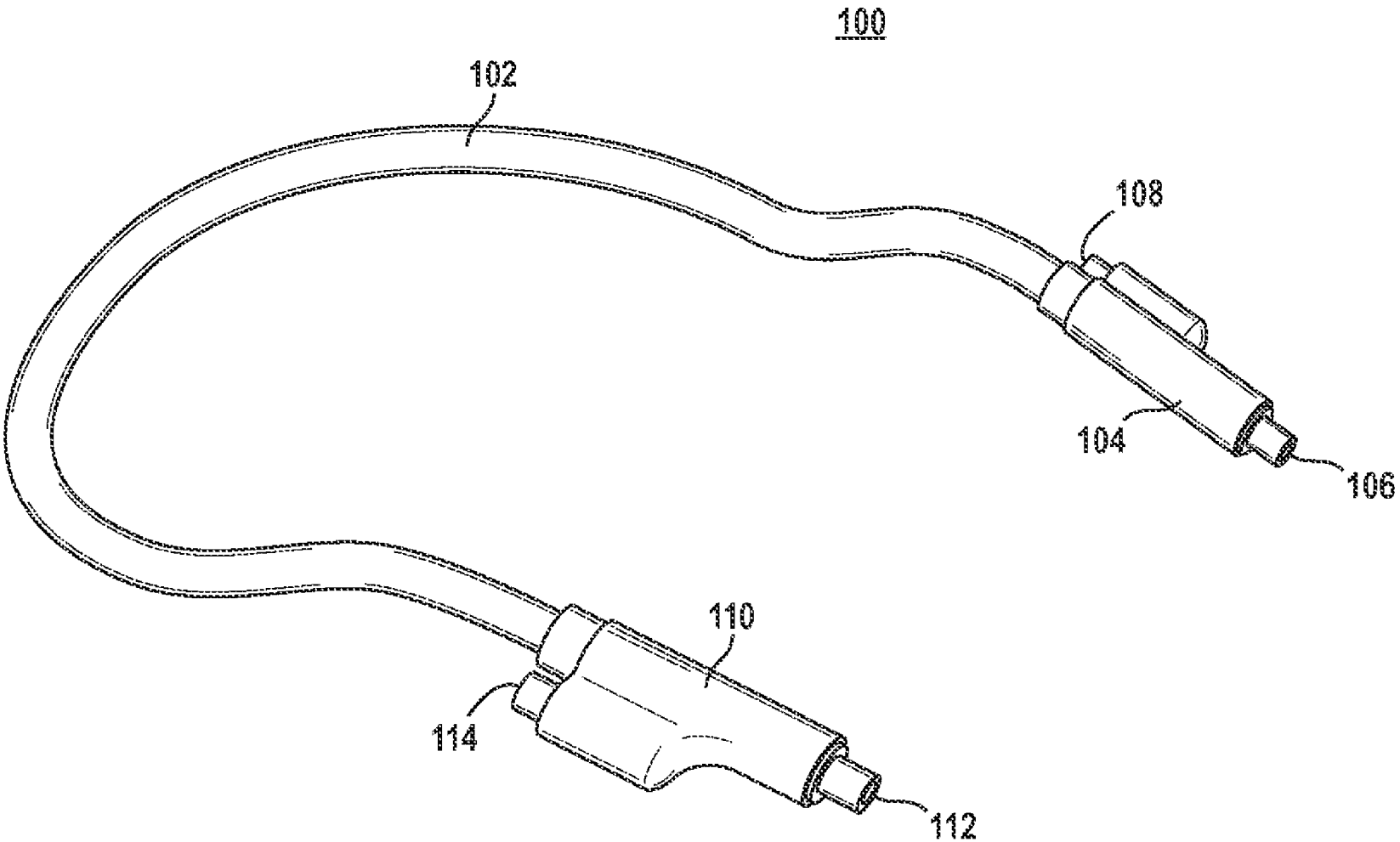
FIG. 1 illustrates a perspective view of a modular input/output headset in accordance with an embodiment.

FIG. 1 illustrates a perspective view of a modular headset in accordance with an embodiment. As shown in FIG. 1, the headset 100 includes a curved headset band 102 which fits around the person's head. The band 102 is preferably flexible and bendable to allow it to be adjusted to comfortably fit on the person's head. It is also possible that the band 102 be worn around the person's neck, whereby attached speakers are able to be worn in the person's ear. It should be noted that the configuration of the band 102 is not limited to that shown in FIG. 1 and other configurations are contemplated.

As shown in FIG. 1, the headset 100 preferably includes a pair of nodes 104, 110 near or at the ends of the band 102, although one or more of the nodes may be placed elsewhere on the band 102. It is also contemplated that one or more of the nodes are selectively removable, although not necessary. In particular to the embodiment in FIG. 1, a left node 104 is shown attached to the end of the band 102, whereby the left node 104 is shown to have a front jack 106 and a rear jack 108. In addition to the embodiment in FIG. 1, a right node 110 is shown attached to the other end of the band 102, whereby the right node 110 is shown to also have a front jack 112 and a rear jack 114. One or more of the jacks 106, 108, 112, and 114 are preferably two-way in which audio, video and/or other types signals (e.g. data signals) from a peripheral device are able to be received through one jack and output from another jack. In an embodiment, one or more of the jacks are configured to be two-way, whereas the remaining jacks are configured to be one-way in that the jacks are designed to only input or output audio signals, depending on the configuration. For instance, one or more jacks may be configured to be input-only in which the jack receives a microphone plug or other input device and allows audio signals input into the microphone to travel via the headset's circuitry to another peripheral device coupled to another jack (e.g. earphone, electronic device). In another instance, a jack may be designed to be output-only in which the jack receives a plug for a earphone bud. It should be noted that although only two nodes and four jacks are shown on the headset 100 in FIG. 1, any number of nodes and jacks, including only one, are contemplated. The jacks may be 2.5 mm or 3.5 mm, although other diameter sizes are contemplated. In an embodiment, the whole unit may be a flex tube with nodes and associated jacks interspersed anywhere along the tub that could be used for the microphones, speakers and/or connection means to the electronic peripheral device.

Figure 2:
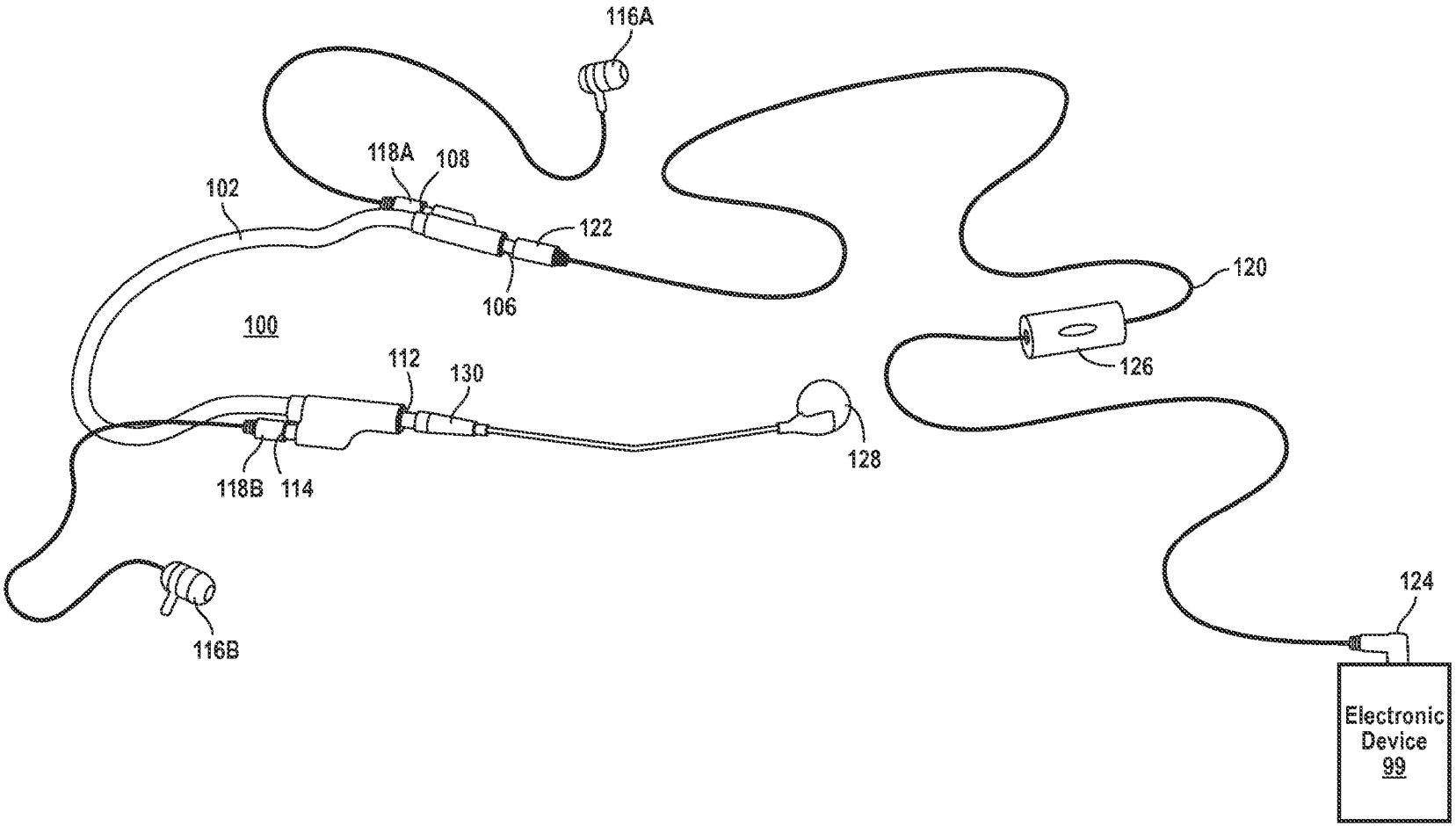
FIG. 2 illustrates a perspective view of the headset connected to several peripheral devices in accordance with an embodiment.

FIG. 2 illustrates a perspective view of the headset 100 connected to several peripheral devices in accordance with an embodiment. As shown in FIG. 2, the headset 100 is connected to a left side ear bud speaker 116A which fits into the user's ear, whereby a plug 118A of the ear bud speaker 116A is shown inserted into the jack 108. Additionally, the headset 100 is connected to a right side ear bud speaker 116*b*, whereby a plug 118B of the ear bud speaker 116B is shown inserted into the jack 114. In addition, the headset 100 includes an interface 120 having a plug 122 on one end which connects to jack 106 and a plug 124 on the opposing end which fits into a jack of one or more peripheral devices such as an external electronic device 99. Such electronic devices include, but are not limited to, audio players or recorders, media players or recorders, DVD players, mobile phones, video game devices, image projectors, televisions, home telephones, smartphones, PDAs, computers and/or associated interface modules; and any other electronic device which has one or more jacks to input and/or output audio and/or video signals. For instance, an electronic device may be a toggling device which allows the user to selectively answer a telephone call or control a media device.

It should be noted that although only one electronic device 99 is shown in the figures, it is contemplated that more than one electronic device 99 may be connected to the headset 100 at the same time. In an example, the headset 100 may be simultaneously connected via different jacks to a mobile phone and a media player (e.g. Ipod) to allow the user to receive calls as well as enjoy media. In an embodiment, the circuitry (described below) may be configured to automatically mute the input the media player when the mobile phone indicates an incoming call.

In the embodiment shown in FIG. 2, the interface 120 includes a push-to-talk and/or volume control features 126, although this is optional. In an embodiment, the interface 120 has the ability to manually activate and deactivate one or more of the jacks, (e.g. muting the microphone). In an embodiment, the interface 120 may have Bluetooth capability to allow the headset 100 to wirelessly interface with any Bluetooth capable peripheral device. In an embodiment, the interface 120 or any other of the peripheral device may be configured to include an additional jack to allow more peripheral devices to connect to the headset 100. In an embodiment, the microphone 128 may include an integrated ear bud to allow listening as well as speaking. In an embodiment, the peripheral device is powered from the electronic device, although it is contemplated that the peripheral device may have its own power source or battery to power the peripheral device.

The headset 100 shown in FIG. 2 is connected to an adjustable microphone 128 in which the microphone 128 includes a plug 130 which is shown inserted into jack 112 of the headset 100. The configuration shown in FIG. 2 allows the headset 100 to be used as a personal hands free communication device for work, driving or other uses in which the user's hands are free to do other tasks. One preferred advantage of the headset 100 is that the jacks 106, 108, 112, 114 universally accept all types of standard peripheral device plugs to allow any combination or configuration of peripheral devices based on the user's need. This is done by the user simply removing a particular peripheral device from its jack and plugging it into another jack. For example, in the embodiment in FIG. 2, the user may choose to have the microphone on the left side of the band 102 instead of the right, as shown. Accordingly, the modular and interchangeable design of the headset 100 allows the user to remove the headset plug 130 from the right side jack 112 as well as remove the interface plug 122 from the left side jack 106, and then insert the headset plug 130 into the left side jack 106 and insert the interface plug 122 into the right side jack 112.

Figure 3:
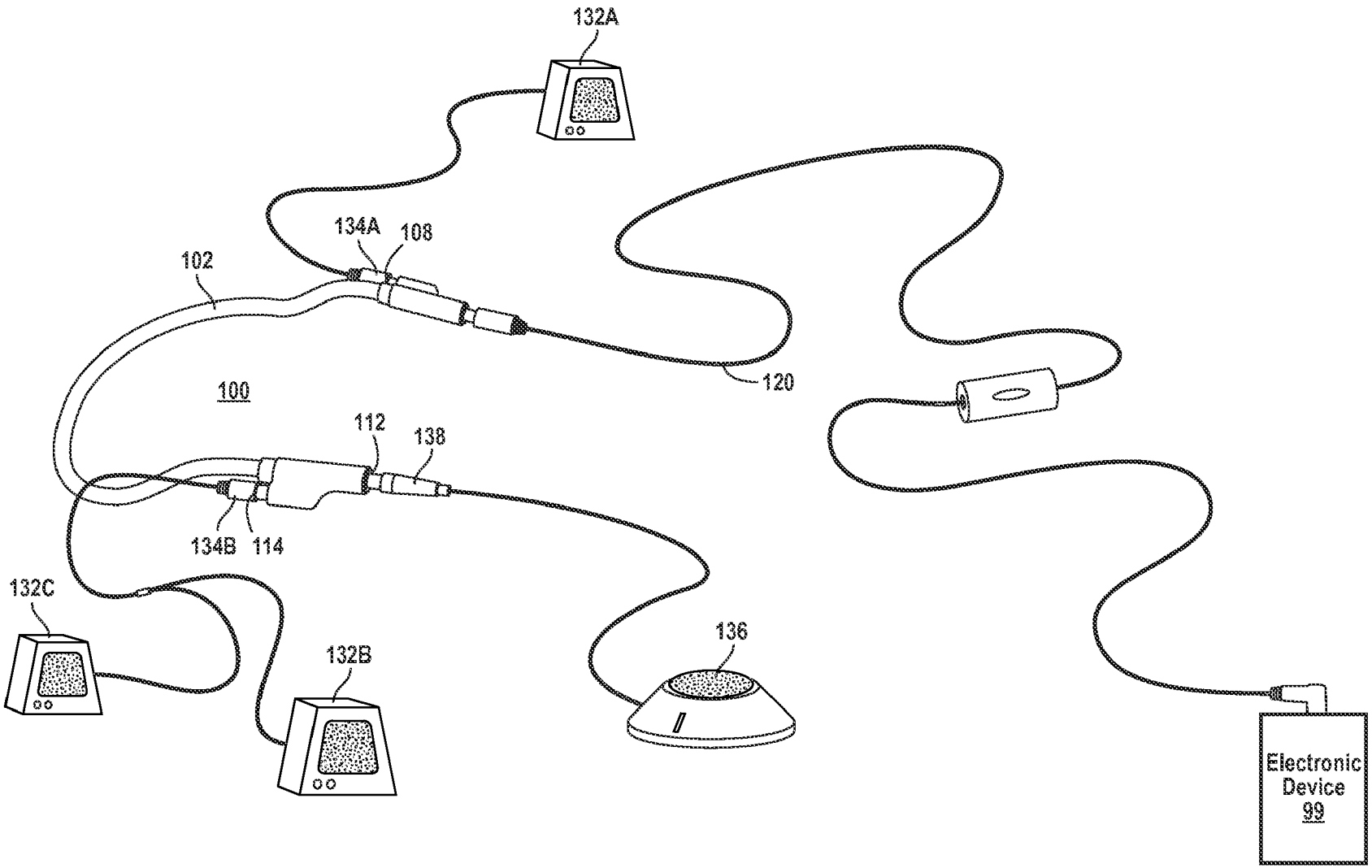
FIG. 3 illustrates another configuration in which the headset is used in accordance with an embodiment.

Another advantage of the headset 100 is that it allows the user to replace a particular peripheral device by removing it from its jack and replacing it with another peripheral device while the user is wearing or not wearing the device. FIG. 3 illustrates another configuration in which the headset 100 is used to interface various peripheral devices for a conference call. As shown in FIG. 3, the headset 100 is connected to an external speaker 132A, whereby a plug 134A of the speaker 116A is shown inserted into the jack 108. Additionally, the headset 100 is connected to a pair of external speakers 132B and 132C, whereby a plug 134B of the pair of speakers 132B and 132C is shown inserted into the jack 114. The external speakers 132A-C are different than the ear bud or headphone speakers in FIG. 2 as they output sound to be heard in a free space or in public, whereas the ear buds preferably are positioned near the user's ear and are for personal use. In addition, the headset 100 is connected to a conference-type microphone 136 via plug 138 which is shown inserted into jack 112. As with FIG. 2, the interface 120 connects the headset, speakers and microphone to the electronic device 99. Thus, the adaptability of the headset 100 allows the user to dynamically change the headset 100 from personal use (as shown in FIG. 2) to a conference type use.

Figure 5:
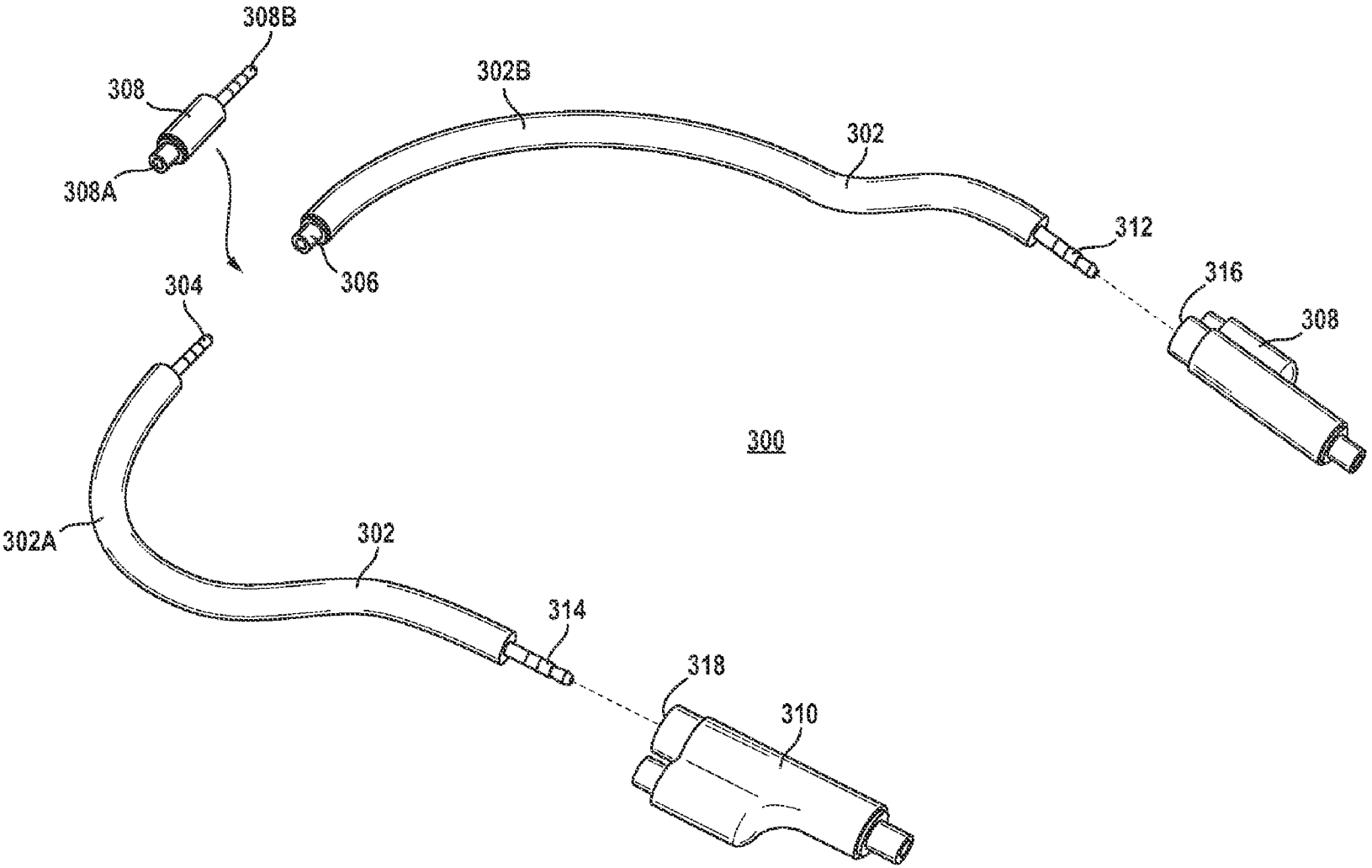
FIG. 5 illustrates an exploded view of the headset connected to several peripheral devices in accordance with an embodiment.

FIG. 5 illustrates an exploded view of the headset in accordance with an embodiment. As shown in FIG. 5, the headset 300 itself is modular in that components of the headset are removable and interchangeable to accommodate different sizes and configurations of the headset. As shown in FIG. 5, the headband itself is separateable into two or more individual components. In particular, the headband can be separated into headband components 302A and 302B, whereby component 302A includes a male plug 304 and component 302B includes a female jack 306. The plug 304 is insertable into the jack 306, whereby electrical connection is established when the two components 302A, 302B are connected to one another. This configuration allows the headband 302 to be separated into two halves, thereby making the device more compact for storage.

As shown in FIG. 5, one or more additional connector components 308 may be attached to the headband 300 to increase the overall size of the headband 300. In particular, connector component 308 includes a male plug 308B which is configured to fit into the jack 306 and the female plug 308A is configured to receive plug 304. It should be noted that although the plug 304 and jack 306 are shown in the middle of the headband 300, the connectors may be located elsewhere on the headband 300. It should also be noted that more than one connector set may be incorporated into the headband 300.

Although the headband is referred to herein as being worn around the user's head, it is contemplated that the device may alternatively be assembled by the user to be worn around other parts of the user's body. For instance, the differently configured components which form the band may be coupled to one another to form a circular band in which can be the circular band can be worn around the user's arm (e.g. during exercise) or worn around the user's waist. In this embodiment, the ear buds and/or microphone may include a longer wire to allow the ear buds to reach the user's ears while it is worn elsewhere.

Additionally or alternatively, the ends of the headband 302 include connectors which allow the nodes 308, 310 themselves to be detached from the headband 302. In particular, the ends of the headband 302 include connector inserts 312, 314 (or receiving jacks) on its ends. Additionally, the nodes 308, 310 include corresponding connectors which allow them to connect to the connectors of the headband 302. In particular, nodes 308, 310 include respective jacks 316 and 318, whereby jack 316 receives plug 312 and jack 318 receives plug 314. As with the above described headset, the circuitry and configuration of connectors in the headset and the nodes allow the nodes 308, 310 to be detached from the headband 302 and moved to another connector of the headband 302 or just replaced with a node having another configuration. Thus, the embodiment in FIG. 5 not only allows interchangeability of peripheral devices with the headset but also allows interchangeability of the components of the headset itself (headband, nodes, etc.) It should be noted that a locking mechanism may be incorporated at the connector interfaces to ensure mechanical integrity and durability between components. One possible locking mechanism may be a bayonet type locking mechanism, whereby the user connects the components ands twist a ¼ turn to lock. Other appropriate locking mechanisms are also contemplated.

It should be noted that although peripheral devices primary to the audio experience are discussed herein, it is contemplated that one or more jacks may be configured to interface with other types of peripheral devices. For example, one or more jacks may be configured to interface with a video peripheral device, such as personal video glasses. Additionally or alternatively, one or more jacks may be configured to receive a personal headlamp or flashlight to aid the user in seeing in darkened areas.

Figure 4:
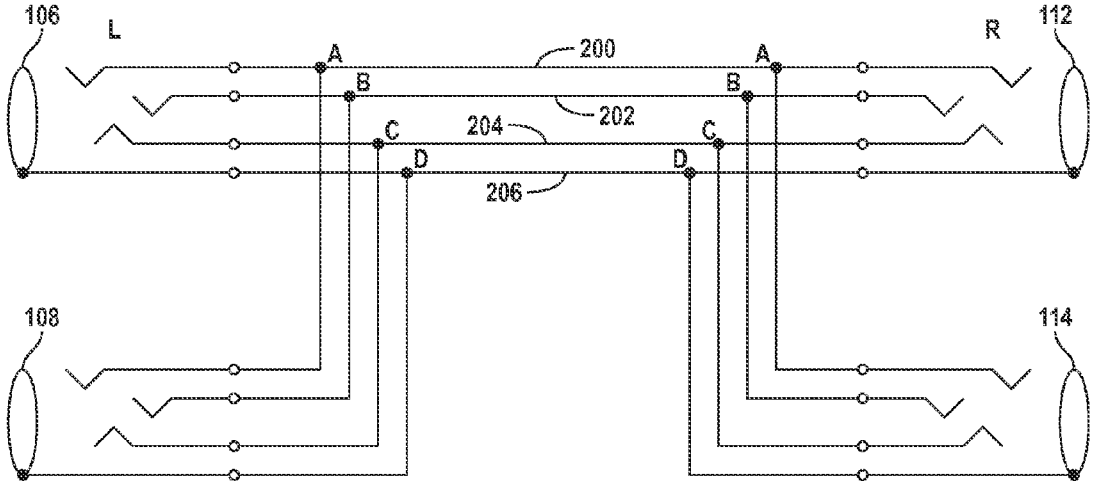
FIG. 4 illustrates the circuitry of the headset in accordance with an embodiment.

FIG. 4 illustrates the circuitry used in the headset 100 which allows the peripheral devices to interchangeably operate with the various types of input and output peripheral device in accordance with an embodiment. It is preferred that the circuitry is located inside the headset band 102 such that they are not visible, although this is not necessary. As shown in FIG. 4, the jacks 106, 108, 112, and 116 are connected to one another using four connector wires 202, 204, 206, 208 to allow the headset 100 to support stereo sound. In an embodiment, one or more jacks are connected using only three connector wires to support mono sound. As shown, the jacks 108 and 114 are connected to the wires 202, 204, 206, and 208 at respective nodes, A, B, C, and D to allow all jacks to transmit signals therebetween and support the same peripheral devices, thereby enabling the modularity of the headset 100.

While embodiments and applications have been shown and described, it would be apparent to those skilled in the art having the benefit of this disclosure that many more modifications than mentioned above are possible without departing from the inventive concepts disclosed herein. The invention, therefore, is not to be restricted except in the spirit of the appended claims.

What is claimed is:

1. A modular headset comprising:

a headset band configured to connect with an external electronic device, the headset band having a first end and a second end;

a first node coupled to the first end of the headset band, the first node having one or more two-way first interfaces, a first interface of the first node configured to interchangeably receive and connect with corresponding interfaces of a plurality of different devices; and circuitry within the headset band coupled to the first interface of the first node, wherein the circuitry is configured to communicate input and output signals between a first peripheral device and the electronic device via the first interface when the first peripheral device is coupled to the first interface, and further wherein the circuitry is configured to communicate output signals from the electronic device to a second peripheral device via the first interface when the second peripheral device is coupled to the first interface.

2. The headset of claim 1, wherein the peripheral device is an integrated microphone and speaker device, wherein signals to and from the integrated microphone and speaker pass through the first input/output interface.

3. The headset of claim 1, wherein the electronic device further comprises a mobile phone and/or media player.

4. The headset of claim 1, wherein one of the plurality of first interfaces further comprises a first input/output jack configured to removably receive a plug of a microphone, wherein an input signal from the microphone is transmittable via the circuitry to the external electronic device through the first input/output jack.

5. The headset of claim 4, wherein one of the plurality of first interfaces further comprises a first output jack configured to removably receive a plug of a first speaker, wherein an input signal from the external electronic device is transmittable via the circuitry to the first speaker through the first output jack.

6. The headset of claim 5, wherein one of the plurality of second interfaces further comprises a second output jack configured to removably receive a plug of a first speaker, wherein the input signal from the external electronic device is transmittable via the circuitry to the second speaker through the second output jack.

7. The headset of claim 6, wherein the first and second speakers are headphone speakers adapted to be in contact with the person's ears.

8. The headset of claim 6, wherein the first and second speakers are standalone speakers adapted to output sound in a free-space.

9. The headset of claim 1, wherein the first node is removable from the headset band.

10. A modular headset comprising:

a curved headset band having a first end and a second end;

a first node coupled to the first end of the headset band, the first node having a first interface and a second interface both configured to interchangeably receive and connect with a selectively removable electronic device and a selectively removable first speaker;

a second node coupled to the second end of the headset band, the second node having a third interface configured to interchangeably receive and connect with a selectively removable second speaker; and two-way circuitry coupled to the first, second, and third interfaces to automatically carry input and output signals therebetween, wherein signals to and from the electronic device pass through the first interface and signals from the electronic device to be output are carried by the circuitry through the second and third interfaces to the first and second output speakers.

11. The headset of claim 10, further comprising a fourth interface connected to the circuitry and configured to selectively receive or transmit signals via the circuitry, the fourth interface configured to receive and connect with a microphone, wherein signals from the microphone pass through the fourth interface to the electronic device via the circuitry.

12. The headset of claim 10, wherein the plug of the external electronic device is removable from the first interface and insertable into the second interface.

13. The headset of claim 10, wherein the plug of the first output speaker is removable from the second interface and insertable into the first interface.

14. The headset of claim 10, wherein the first and second speakers are headphone speakers adapted to be in contact with the person's ears.

15. The headset of claim 10, wherein the first and second speakers are standalone speakers adapted to output sound in a free-space.

16. A method comprising:

selecting a curved headset band having a first end and a second end;

selecting a first node coupled to the first end of the headset band, the first node having a first interface and a second interface, the first interface adapted to interchangeably receive and connect with a selectively removable microphone and the second interface configured to interchangeably receive and connect with a selectively removable first output speaker;

selecting a second node coupled to the second end of the headset band, the second node having a third interface adapted to removably connect the headset to an electronic device and a fourth interface to receive a removable second output speaker; and configuring two way circuitry to be in electrical communication with the first, second, third and fourth interfaces, wherein signals from the electronic device to the headset travel via the third interface are automatically carried by the circuitry to the second interface and the fourth interface to be output via the first and second output speakers, further wherein input signals from the microphone travel via the circuitry from the first interface to the second interface and the electronic device.

17. A modular headset comprising:

a headset band having a first end and a second end;

a plurality of interfaces coupled to the headset band, each interface configured to interchangeably receive and connect with a plurality of different devices; and two-way circuitry within the headset band coupled to the plurality of interfaces, the circuitry configured to carry input and output signals from a first device connected to a first interface to at least one second device connected to any other interface of the headset band.

18. A modular headset comprising:

a headset band having a first end and a second end;

a first node removably coupled to the first end of the headset band, the first node having a plurality of first interfaces configured to interchangeably couple with a plurality of different devices;

a second node removably coupled to the second end of the headset band, the second node having at least one second interface configured to couple with an electronic device, the at least one second interface also configured to couple with any of the plurality of different peripheral devices; and two-way circuitry within the headset band coupled to the interfaces at the first and second nodes, wherein the circuitry carries input and output signals between the device coupled to any of the first interfaces in the first node and the electronic device coupled to the at least one second interface.

* * * * *